US007204636B2

(12) United States Patent
Didion

(10) Patent No.: US 7,204,636 B2
(45) **Date of Patent: *Apr. 17, 2007**

(54) GRANULAR AND AGGREGATE BLENDING, COOLING AND SCREENING ROTARY DRUM

(75) Inventor: Charles J. Didion, St. Charles, MO (US)

(73) Assignee: Didion Manufacturing Company, St. Peters, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/133,899

(22) Filed: May 20, 2005

(65) Prior Publication Data

US 2005/0236320 A1 Oct. 27, 2005

Related U.S. Application Data

(63) Continuation-in-part of application No. 10/336,927, filed on Jan. 7, 2003, now Pat. No. 6,896,400.

(51) Int. Cl.
*B01F 9/02* (2006.01)
*B01F 15/06* (2006.01)

(52) U.S. Cl. ..... 366/147; 366/227; 366/228; 366/234; 34/137; 432/111; 432/118

(58) Field of Classification Search ..... 366/7, 366/22–25, 53–59, 219–234, 147; 432/103–119; 34/135–138
See application file for complete search history.

(56) References Cited

U.S. PATENT DOCUMENTS 2,080,508 A * 5/1937 Sackett ..... 366/227
3,866,888 A 2/1975 Dydzyk
3,998,262 A 12/1976 Didion
4,035,925 A * 7/1977 Brown et al. ..... 34/135
4,050,635 A 9/1977 Mueller et al.
4,071,962 A 2/1978 Saeman
4,332,478 A 6/1982 Binz
4,724,777 A 2/1988 Reed et al.

(Continued)

FOREIGN PATENT DOCUMENTS

JP 59-27953 * 2/1984

*Primary Examiner*—Charles E. Cooley
(74) *Attorney, Agent, or Firm*—Paul M Denk

(57) ABSTRACT

A rotary drum configured for the efficient blending, cooling, and screening of granular products having an outer cylindrical shell, an intake end, and an exit or discharge end. The rotary drum is normally rotated at a predetermined speed by a conventional drive package. Disposed on an inner surface of the cylindrical shell is a plurality of compound helical flights and scoops or lifts, configured to blend granular product as it cascades from the intake end to the discharge or exit end of the rotary drum. A coaxially disposed cylindrical air passage adjacent the discharge end of the rotary drum, comprising an inner cylinder, that directs a counter flow of cooling air through the rotary drum towards the intake end, for cooling the cascading granular product as it approaches the screening segment of the rotary drum. The rotary drum having a plurality of discharge ports and grading screens just before its discharge end, provided in the surface of the outer cylindrical shell adjacent to the discharge end, to allow for the passage of air for attaining dust collection, while the counter flowing cooling air passes through the internally arranged inner cylinder to achieve the cooling effect within the rotary drum.

7 Claims, 8 Drawing Sheets

U.S. PATENT DOCUMENTS

| | | | | |
|---|---|---|---|---|
| 4,787,938 | A | 11/1988 | Hawkins | |
| 4,981,581 | A | 1/1991 | Didion | |
| 5,016,827 | A | 5/1991 | Didion | |
| 5,095,968 | A | 3/1992 | Didion | |
| 5,538,340 | A | 7/1996 | Brashears | |
| 5,558,432 | A | 9/1996 | Swisher, Jr. | |
| 5,581,902 | A | 12/1996 | Didion et al. | |
| 5,603,567 | A | 2/1997 | Peacock | |
| 5,613,902 | A | 3/1997 | Didion et al. | |
| 5,628,126 | A * | 5/1997 | North | 34/137 |
| 5,664,881 | A | 9/1997 | Hawkins et al. | |
| 6,896,400 | B2 * | 5/2005 | Didion | 366/228 |

* cited by examiner

GRANULAR AND AGGREGATE BLENDING, COOLING AND SCREENING ROTARY DRUM

CROSS-REFERENCE TO RELATED APPLICATIONS

This continuation-in-part patent application claims priority to the non provisional patent application having Ser. No. 10/336,927, which was filed on Jan. 7, 2003, now U.S. Pat. No. 6,896,400.

BACKGROUND OF THE INVENTION

The present invention relates generally to a rotary drum as used in the granular product drying field, and having a major application for the treatment of heated and moist granular products such as mold sands, grains, and fertilizers as to achieve the reclaiming, cooling, and blending of the mold granular product and in particular, to a dust collection hood and discharge chute configured to convey multiple air streams through the rotary drum for the cooling of the granular product.

There are a variety of prior patents that have been obtained upon various styles of rotary drums for use in the metal casting industry. For example, one of the early embodiments is that which is shown in U.S. Pat. No. 3,998,262 to Charles J. Didion, showing a casting shakeout unit and method of operation. Essentially, such a drum is arranged upon its structural support and rotated by means of a drive unit, so that when castings clogged with mold sand as obtained directly from the site of their casting, are then passed through the rotary drum, the mold sand is effectively separated and removed from the prepared castings, to achieve the required separation without necessitating the employment of any manual labor to attain such results.

The usage of shrouds or hoods around the discharge end of the rotary drum has been employed in the prior art, as can be seen in U.S. Pat. No. 4,050,635 to Mueller, et al., wherein the shown housing incorporated an outlet chute, at is lower end, for attaining the discharge of the castings, or its sand, therefrom, during operations of the shown device. In addition, such hoods have been used for collection and removal of sand particles, to facilitate the collection of the sand in preparation for its re-usage.

Similarly, the usage of a ventilating hood on a rotary drum, having various ventilating ports designed therein so as to accommodate the flow of air around and through the discharge end of the rotary drum, for the removal of heat from sand and containment of fines and dust, while likewise diverting the separated mold sand for passage to a discharge opening, as arranged at the bottom of the ventilating hood is shown in U.S. Pat. No. 4,981,581 to Charles J. Didion.

However, it has been found that the removal of heat from hot granular products by exposure to an airflow only at the discharge end is insufficient to reduce the temperature of the granular products to near ambient temperatures. Accordingly, there is a need for a reclaiming rotary drum configuration which is capable of removing heat and moisture from granular products from the point of intake through the discharge end, to increase the heat removal, and to reduce the granular product temperature to near ambient conditions at the discharge end.

BRIEF SUMMARY OF THE INVENTION

Briefly stated, the invention sets forth a rotary drum configuration for the efficient blending, cooling, and screening of granular products. The rotary drum is of the type that is an elongated structure, generally having an outer cylindrical shell, an intake end, and a discharge end. The rotary drum is normally rotated at a predetermined speed by means of a conventional drive package. Disposed on an inner surface of the cylindrical shell are a plurality of compound helical flights and scoops, configured to blend granular product as it cascades from the intake end to the discharge end of the rotary drum. A coaxially disposed cylindrical air passage adjacent the discharge end of the rotary drum directs a counter flow of cooling air through the rotary drum towards the intake end, cooling the cascading granular product as it approaches the discharge end. A plurality of discharge ports and grading screens in the surface of the outer cylindrical shell adjacent the discharge end provide an entrance for a second counter flow of cooling air while simultaneously providing passage for the granular product to drop downwards towards an outer coaxial discharge passage. A series of external helical flights on the outer surface of the cylindrical shell urge granular product in the outer coaxial discharge passage out the discharge end of the rotary drum. The upper section of the discharge end contains an opening therethrough, and mounted in proximity with the opening, or in communication through duct work with the opening, is a vacuum pump which is designed to provide a reduced pressure for attracting air, particularly that air in which the dust and sand fines from the granular product are entrained, so as to achieve their removal.

In an alternative embodiment of the present invention, an air manifold and air pump is operatively coupled to the cylindrical air passage, the discharge ports, or both to provide a positive pressure counter flow of air through the respective passage or ports.

A further embodiment of this invention is to provide aggregated screening and grading of the granular material in that section provided near the end of the rotary drum. The granular product and aggregate blending, cooling, and screening by this rotary drum is constructed generally into at least three segments, the first segment being the intake segment, provided for the intake of the granular product, a second segment being the blending segment for the granular product, and the third segment, including a series of helically arranged internal vanes for moving the granular product longitudinally therealong. Also, it is in this segment of the drum that, in a further embodiment, the graduated screening takes place, so as to grade the granular material being processed, and cooled. For example, not only may aggregate, sand, mold sand, but also even foundry debris, may be passed through this rotary drum, screened, separated, all for further processing. And, in the event that the materials being processed by the rotary drum are excessively heated, such as castings, or by-product that is generated from recent casting, and is excessively heated, or any heated composition that needs grading, a cooling means is provided at the end of the drum, as noted, and blows counter flow to the movement of the media being processed, to help achieve its cooling. Also, if the materials being graded are wet or moist, a heater may be used in lieu of a blower to dry the materials.

In addition, in an alternative embodiment, an inner cylinder is provided along at least a portion, or more, of the third segment of the rotary drum, so that the air can pass directly through the screening segment, and into the second and first segments of the rotary drum, to achieve significant cooling at that location. Furthermore, a dust collector hood is provided around the portion of the third segment, in order to collect any dust that is generated within the rotary drum, during its screening operations, and to attain its entrapment and collection.

It is, therefore, a further object of this invention to provide a rotary drum that reduces scrap and cleaning cost within a plant, due to the lower sand temperature and improved sand conditions.

Another object of this rotary drum is that it provides for more uniforms sand to muller, improves the muller efficiency and consistency of the sand conditions during its processing.

Still another object is to provide a rotary drum that is very rugged, of durable construction, and requires a minimum of maintenance even during continuous operations.

Another object is to provide a rotary drum with an open end design, with no center shafts, that allows for easier loading by vibratory conveyors or feeders.

Still another object is to provide a rotary drum that is simple, utilizes a smooth drive system that does not generate any high frequency of vibrations, thus eliminates the need for special foundations and large spare parts inventories.

Yet another object is to provide a rotary drum and use of precision laser alignment of the main support bearings, thereby allowing the drum to run level, thus eliminating thrust loads and minimizes wear.

Still another object of this invention is to provide lifter bars or paddles, in combination with helical flights, that improves the processing of the sand, or other granular material, and provides for a thorough blending, mixing, and break down of the aggregate, in preparation for its grading, through screening, and cooling throughout its passage longitudinally within the rotary drum of this invention.

Another object is to utilize optional stainless steel segments that form screens, in the form of panels, to provide better screening of the sand and granular material, and which furnishes better wear resistance, yet provides screen segments that are easily replaced.

Another object of this invention is to provide a rotary drum wherein its dust is contained entirely within the machine.

The foregoing and other objects, features, and advantages of the invention, as well as presently preferred embodiments thereof will become more apparent from the reading of the following description in connection with the accompanying drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
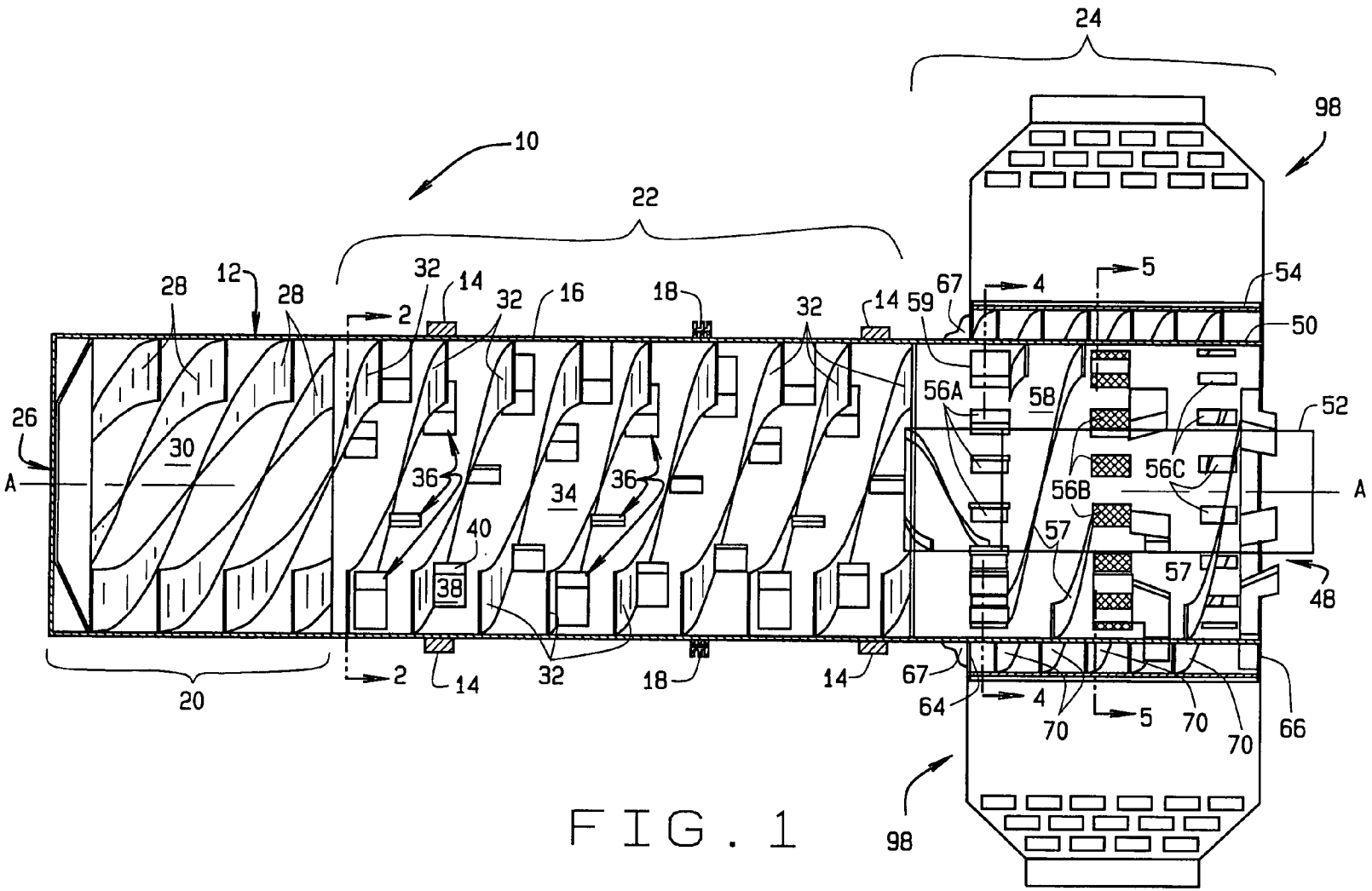
FIG. 1 is a longitudinal sectional view of a rotary cooling, blending, and screening drum.

Turning to FIG. 1, a rotary drum of the present invention for effecting the blending and cooling of granular product is shown generally at 10. The rotary media drum 10 comprises a cylindrical drum body 12, which is includes a plurality of spaced circumferential drum assembly tires 14 disposed on an external surface 16. The circumferential drum assembly tires support the rotary drum 10 on a conventional base (not shown). Correspondingly, a circumferential sprocket 18 on the external surface 16 engages a conventional drive mechanism (not shown) in the conventional base to drive the rotary drum 10 at a slow speed of rotation.

The cylindrical body 12 is preferably formed of at least three cylindrical segments 20, 22, and 24. The first segment 20 is an intake segment configured with an intake opening 26 for the intake of high temperature granular product having a high moisture content. The intake segment 20 includes a first series of helically arranged internal vanes 28 disposed on an inner surface 30 for moving the granular product longitudinally through the intake segment 20 from the intake opening 26 to the second segment 22.

The second segment 22 is a blending segment configured for the blending of the granular product in a cascading manner. The blending segment 22 including a second series of helically arranged internal vanes 32 on an inner surface 34 for moving the granular product longitudinally through the blending segment 22 from the intake segment 20 to the third segment 24. Preferably, multiple internal vanes 32 are disposed in a compound helix on the inner surface 34, to achieve a greater efficiency in moving the granular product through the blending segment 22.

Figure 2:
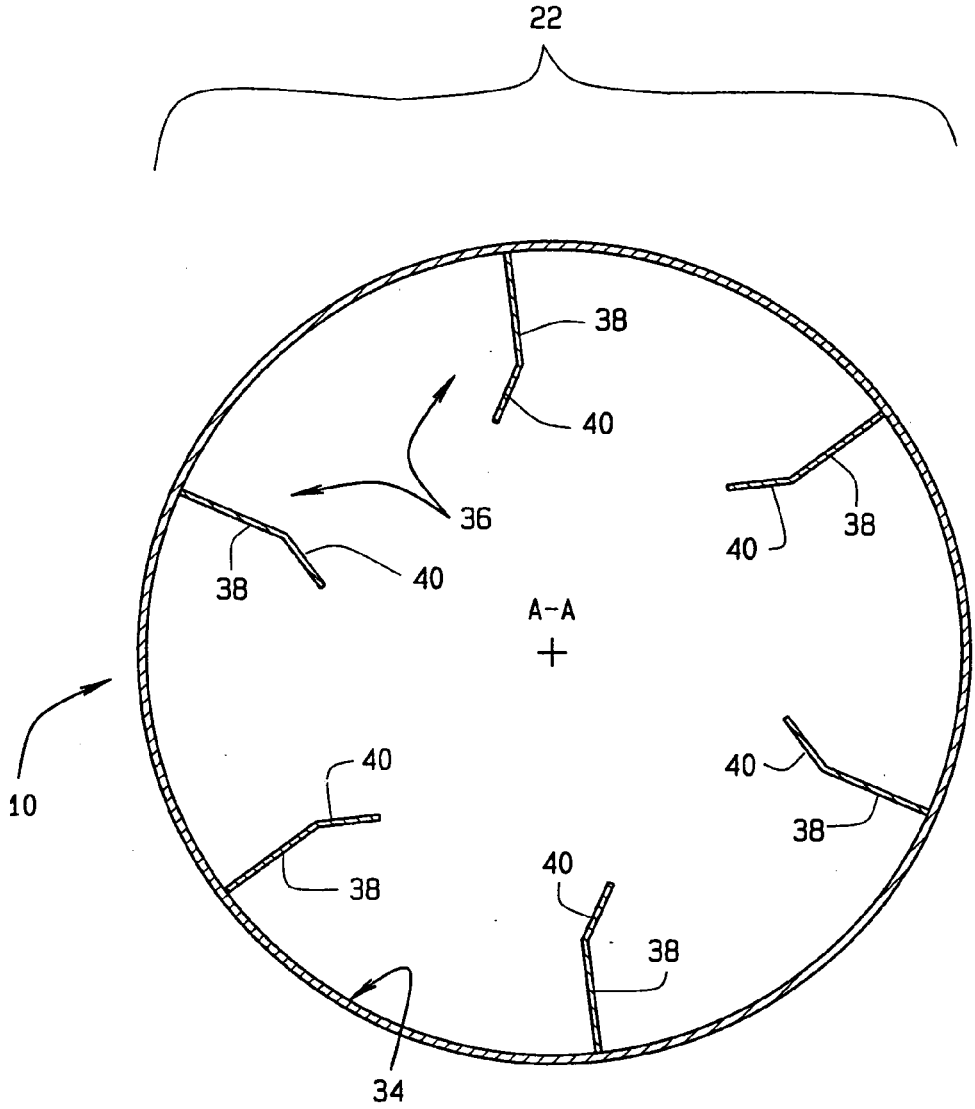
FIG. 2 is a cross sectional view of the rotary cooling, blending, and screening drum of FIG. 1, taken at line 2—2.

A plurality of scoops 36, are disposed on the inner surface 34 adjacent to, and along the length of, the second series of internal vanes 30. As best seen in FIG. 2, the spacing of the scoops 36 is selected such that the scoops 36 are spaced along the discharge side of the second series of internal vanes 30, at regular intervals about the longitudinal axis of the blending segment 22.

Each scoop 36 in the blending segment 22 consists of a base plate 38 fixed perpendicular to the inner surface 34, longitudinally aligned with the center axis of the rotary drum 10. Each base plate 38 terminates with an angled flange 40 disposed on a radially inward edge, oriented in the direction of rotation about the central axis of the rotary drum 10. As granular product flows longitudinally through the blending segment 22 along each internal vane 30 in response to the counter-clockwise rotation of the rotary drum 10, the granular product accumulates against the base plate 38 of each scoop 36. The angled flange 40, orientated in the direction of rotation, holds a portion of the granular product against the flat base portion 38 as the rotation of the rotary drum 10 lifts the granular product around the axis of rotation. As each scoop 36 approaches the highest point of rotation about the longitudinal axis of the rotary drum 10, the retained granular product spills of the angled flange 40, and cascades back to the lower portion of the blending segment 22, where it is re-mixed and blended with additional sand entering the blending segment 22. As the granular product cascades through the blending segment 22, the overall temperature and moisture content of the granular product is reduced through evaporation and heat loss.

Figure 3:
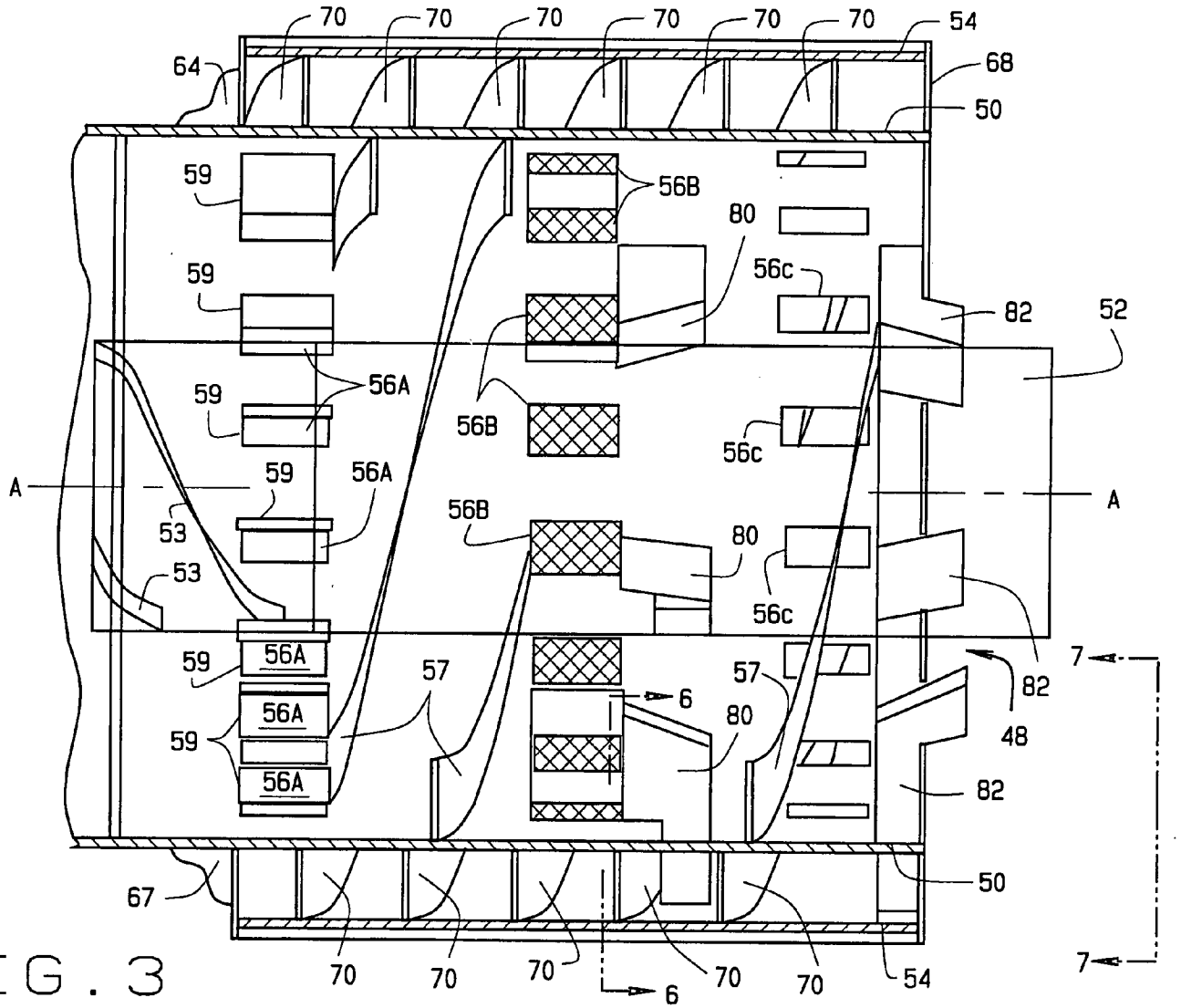
FIG. 3 is an enlarged view of the discharge segment of the rotary cooling, blending, and screening drum of FIG. 1.

Turning to FIG. 3, the third segment 24 of the rotary drum 10 is a discharge segment configured for the collection of airborne dusts and fines in the rotary drum 10 and the discharge of cooled and blended granular product through a discharge opening 48. The discharge segment 24 consists of three concentric cylinders 50, 52, and 54 and is contained within a conventional sand and dust collection hood 100, such as shown in U.S. Pat. No. 4,981,581 to Didion, herein incorporated by reference. The first cylinder 50 is defined by the cylindrical drum body 12, and includes a plurality of equidistantly spaced discharge ports 56 disposed in three sets denoted 56A, 56B, and 56C, along the longitudinal axis of the discharge segment 24. A third series of helically arranged internal vanes 57 is disposed on an inner surface 58 of the first cylinder 50 for moving the granular product longitudinally through the discharge segment 24 from the blending segment 22 to a discharge opening 48.

Figure 4:
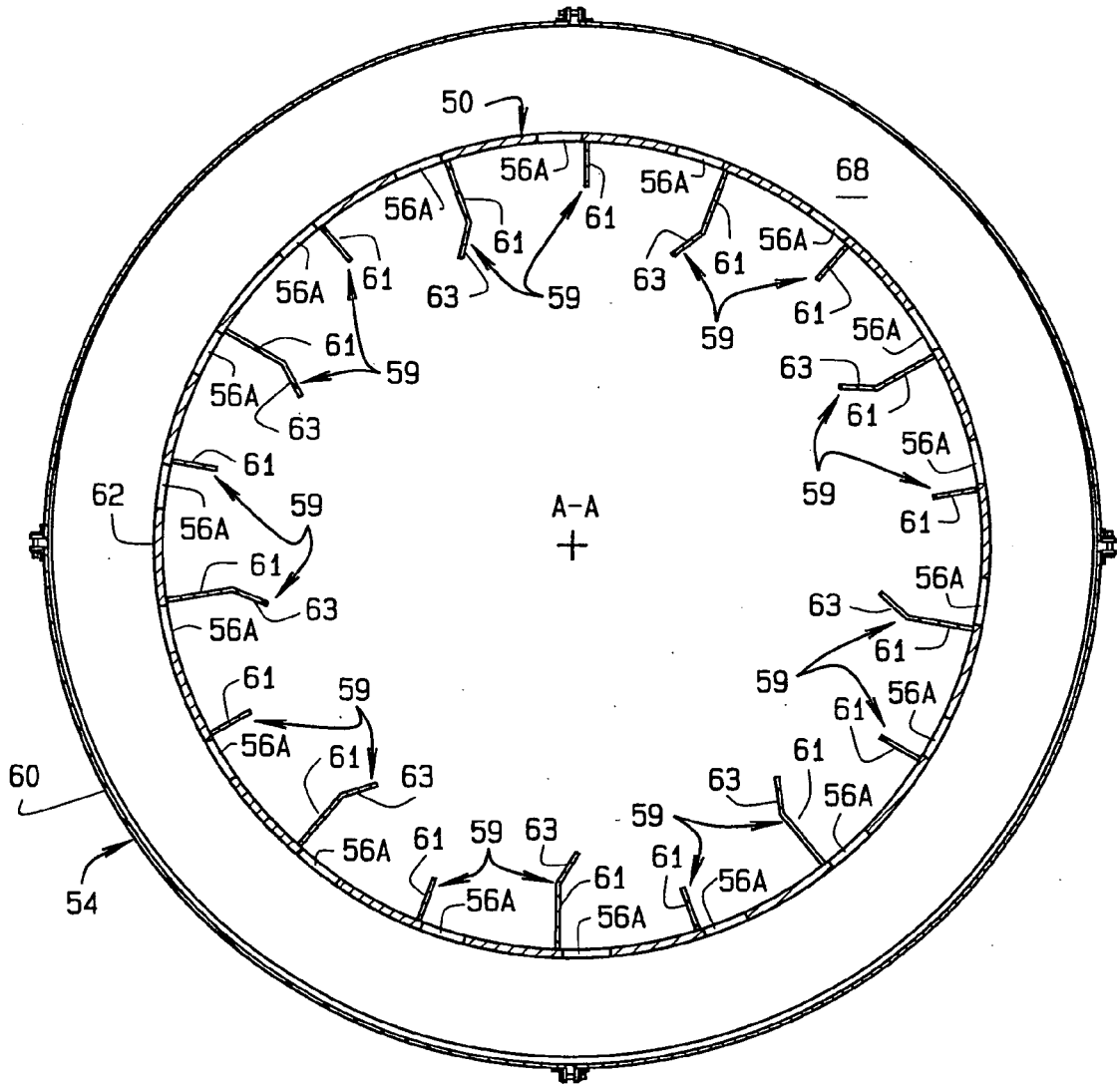
FIG. 4 is a cross sectional view of the rotary cooling, blending, and screening drum of FIG. 1, taken at line 4—4.

Adjacent each discharge port 56A in the first set, on the inner surface 58 of the first concentric cylinder 50 is a scoop 59. As best seen in FIG. 4, the spacing of the scoops 59 is selected such that the scoops 59 are at regular intervals about the longitudinal axis of the blending segment 22, corresponding to the placement of the discharge ports 56A. Each scoop 59 in the discharge segment 24 consists of a base plate 61 fixed perpendicular to the inner surface 58, longitudinally aligned with the center axis of the rotary drum 10. Alternating base plates 61 terminate with an angled flange 63 disposed on a radially inward edge, oriented in the direction of rotation about the central axis of the rotary drum 10.

Figure 5:
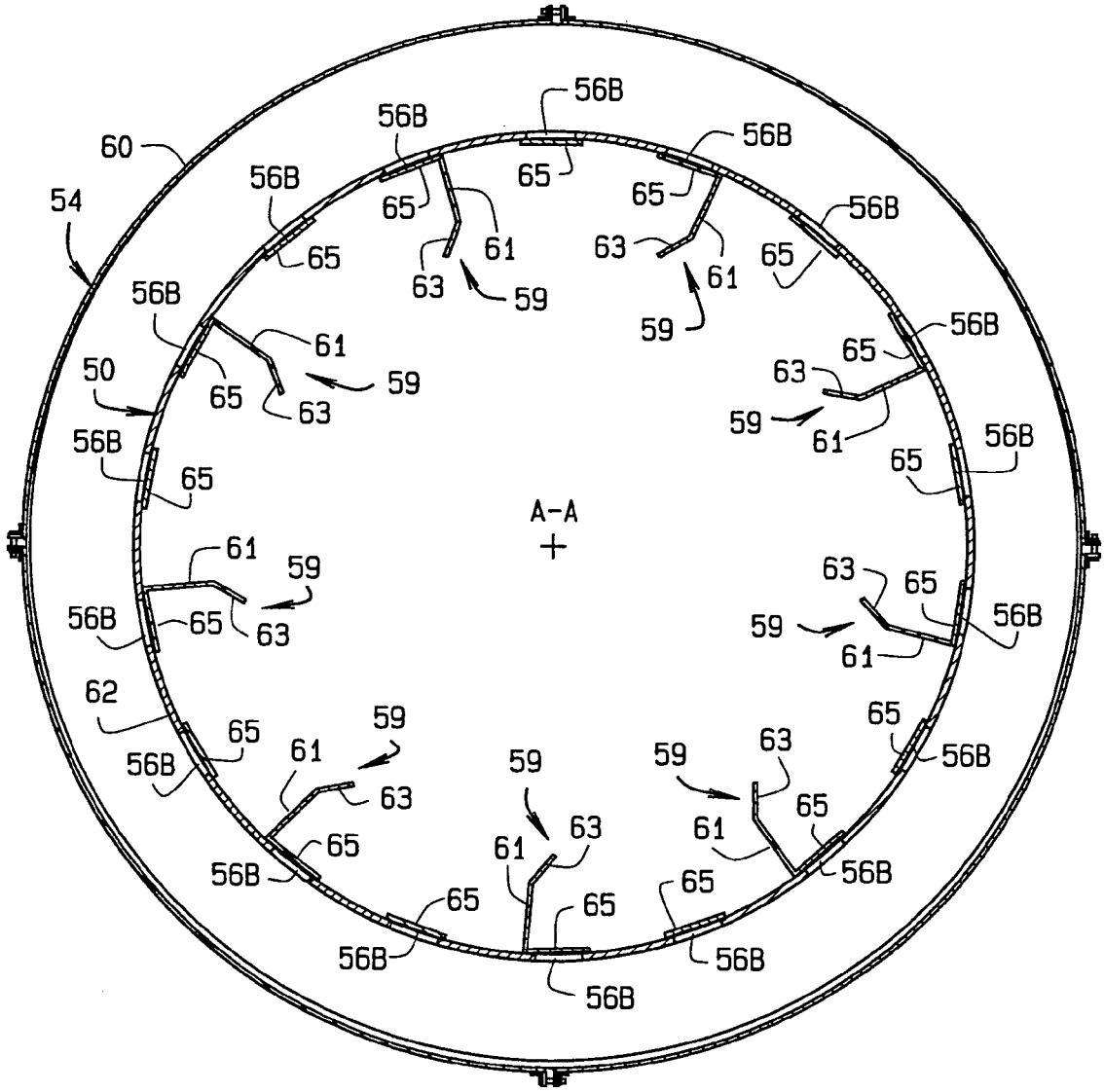
FIG. 5 is a cross sectional view of the rotary cooling, blending, and screening drum of FIG. 1, taken at line 5—5.

At the second set of discharge ports 56B, scoops 59 consisting of both a base plate 61 and an angled flange 63 are disposed adjacent alternating discharge ports 56, as best seen in FIG. 5. In addition, each discharge port 56B in the second set is covered by a mesh grill 65 having openings of a predetermined size for the passage of a portion of the granular product.

At the third set of discharge ports 56C, no scoops are present, and the openings are fully exposed, permitting passage of granular product into and out of the first concentric cylinder 50.

As granular product flows through the first concentric cylinder of the discharge segment 24, portions thereof are either directed by the scoops 59 through the discharge ports 56A or 56B, or is carried up and cascaded downward for cooling and blending by the rotation of the rotary drum 10 about the central axis.

Axially disposed with in the first cylinder 50 of the discharge segment 24, the second cylinder 52 defines an axial air duct configured to convey a longitudinal cooling air flow from a positive air flow external source, preferably adjacent the discharge opening 48, to the blending segment 22. A set of reverse helical vanes 53 is disposed within the axial air duct 52, adjacent the air discharge end in the blending segment 22. The reverse helical vanes 53 are configured to redirect any granular product falling into the air duct 52 back out into the blending segment 22. The longitudinal cooling air flow is directed counter to the longitudinal movement of the granular product through the rotary drum 10, and is exhausted out the intake opening 26 in the intake segment 20. As the longitudinal counter flow of air moves through the blending segment 22 and the intake segment 20, heat and moisture is absorbed from the granular product and conveyed out, cooling and drying the granular product as it cascades through the blending segment 22.

The third concentric cylinder 54 is disposed radially outward from the first cylinder 50 of the discharge segment 24. The third concentric cylinder 54 comprises a cylindrical screen 60 which is secured to the exterior surface 62 of the first cylinder 50 by an intake side radial flange 64 and a discharge side radial flange 66, defining a cylindrical chamber 68 between the first concentric cylinder 50 and the third concentric cylinder 54. Gussets 67 between the intake side radial flange 64 and the exterior surface 62 provide additional strength. The cylindrical chamber 68 is in communication with the interior of the first concentric cylinder 50 through the discharge ports 56A, 56B, and 56C for the entrance of granular product. The cylindrical screen 60 is selected to pass granular product particles which are smaller than a predetermined size, such as those which are suitable for re-use in a mold casting process. A series of helically arranged external vanes 70 are disposed on the exterior surface 62 of the first cylinder 50, within the cylindrical chamber 68. The external vanes 70 are configured such that the rotation of the rotary drum 10 will urge larger granular product particles contained within the cylindrical chamber 68 towards the discharge opening 48.

Cylindrical screen 60 is further configured to permit a radial flow of air from the lower region of the conventional sand and dust collection hood 98 into the cylindrical chamber 68, and a radial flow of air from the cylindrical chamber 68 into the upper region of the conventional sand and dust collection hood 98. The radial inward and upward flow of air passes through the cylindrical screen 60 radially counter flow to the outward movement of granular product particles, and into the cylindrical chamber 68. The flow of air then continues around the external vanes 70 and through the discharge ports 56, into the interior of the first concentric cylinder 50. Continuing upward, the flow of air move around the second concentric cylinder 52 and follows the reverse sequence to exit at the upper portion of the conventional sand and dust collection hood 98. As the flow air passes radially through the cylindrical chamber 68, it entrains sand fines and dust, and absorbs additional quantities of heat and moisture from the granular product, which are then evacuated from the rotary drum 10 for filtering and recovery.

In an alternate embodiment, suitable for demanding cooling and moisture reduction applications, a conventional blower or fan (not shown) can be coupled to the lower portion of the conventional sand and dust collection hood 98 to provide for a more upward positive airflow in and through the discharge segment 24.

Figure 6:
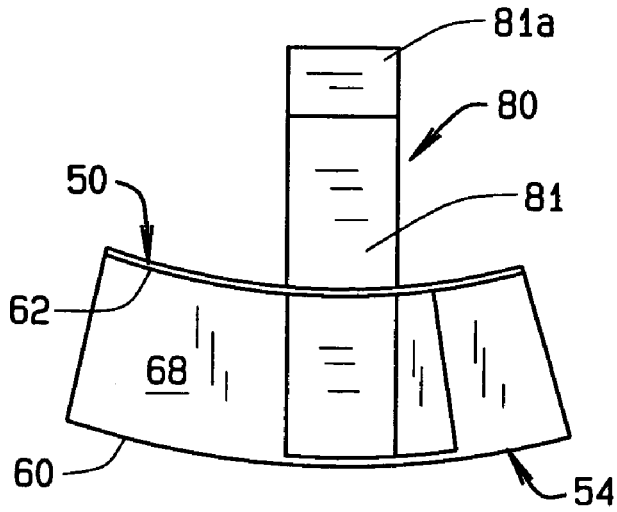
FIG. 6 is a component view of the reverse scoop assembly within the discharge segment taken along the line 6—6 of FIG. 3.

Additionally included within the discharge segment 24 of the preferred embodiment are a plurality of reverse scoop assemblies 80 and discharge scoop assemblies 82. As seen in FIG. 6, each reverse scoop assembly 80 consists of scoop 81 and a reverse blade 81*a*. Each reverse scoop assembly 80 is configured to redirect granular product within the discharge segment 24, which has not yet passed through the cylindrical screen 60 back within the discharge segment 24 for additional circulation and break-down.

Figure 7:
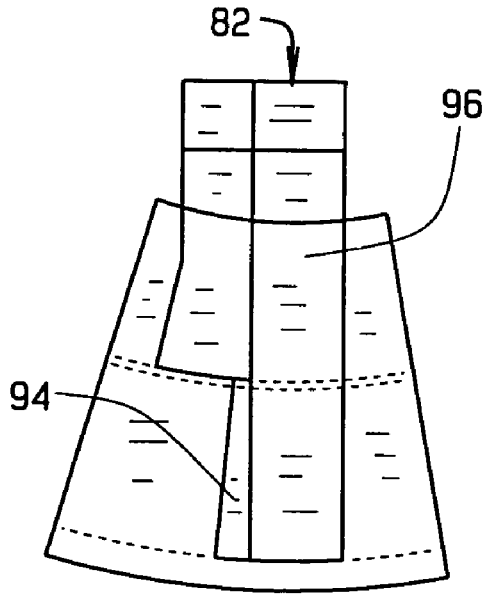
FIG. 7 is a component view of the discharge scoop assembly taken along the line 7—7 of FIG. 3.

Each discharge scoop assembly 82, shown in FIG. 7, is disposed adjacent the discharge opening 48 of the discharge segment 24, and consists of a first inclined plate 94 disposed in the cylindrical chamber 68, and a second inclined plate 96 disposed adjacent the inner surface 58. The first inclined plate 94 is configured to direct granular product accumulating adjacent thereto within the cylindrical chamber 68 in a radially inward direction, towards the discharge opening 48. Correspondingly, the second inclined plate 96 is configured to direct granular product accumulating adjacent thereto within the first concentric cylinder radially inward and towards the discharge opening 48, where it is discharged from the rotary drum 10.

Returning to FIG. 1, during operation of the rotary drum 10 of the present invention, heated and wet granular product is conveyed to the intake opening 26 and deposited within the intake segment 20. Rotating motion of the rotary drum 10 causes the a first series of helically arranged internal vanes 28 to mix and homogenize the granular product thoroughly, and to move it longitudinally through the intake segment 20 towards the blending segment 22. As the sand cascades downstream through the main blending segment 22 of the rotary drum, the counter flow of air passing therethrough from the air duct 52 evaporates moisture present in the sand, cooling it. The rotating, lifting, and cascading action of the second series of helically arranged internal vanes 30 and scoops 36 provides constant exposure of fresh surface area to the longitudinal counter flow of air to achieve a high degree of sand cooling. Additionally, the back blending and intermixing within the blending segment 22 blends the various zones of the granular product such that the granular product is consistent in temperature and moisture content upon exiting the blending segment 22 and entering the discharge segment 24. p Once in the discharge segment 24, portions of the granular product are urged through the discharge ports 56A, 56B, and 56C by the interaction of the third series of helically arranged internal vanes 57 and the scoops 59. Portions of granular product passing through the discharge ports 56A and 56B and into the cylindrical chamber 68 passes downward through the cylindrical screen 60 and exits the rotary drum 10. Particles of granular product which are to large to pass through the cylindrical screen 60 are urged towards the discharge end of the rotary drum 10 by the series of helically arranged external vanes 70. At the discharge end, the remaining granular product, generally consisting of particles to large to pass through the cylindrical screen 60, is discharged from the rotary drum 10 by interaction with the discharge scoops 82 disposed adjacent the discharge opening 48.

To further cool and dry the granular product, and to remove fines or dusts contained therein, a second counter flow of air is directed through the granular product in the discharge chamber 24. The second counter flow of air generally enters the discharge chamber through the lower portion of the conventional sand and dust collection hood, passes through the cylindrical screen 60, and into the discharge ports 56A, 56B, and 56C below the axis of the rotary drum 10. The air circulates around the coaxial air duct 52, and passes upward through the discharge ports 56A, 56B, and 56C above the axis of the rotary drum, again passing through the cylindrical chamber 68 and exiting the discharge chamber 24 through the upper portion of the conventional sand and dust collection hood 98, carrying with it entrained particles, dust, moisture, and absorbed heat from the granular product. The duct 52 is a solid cylindrical member. Generally, it does not have any vents therethrough. On the other hand, in an alternative embodiment, one or more screens may be provided within the air duct 52, and allow some air to circulate through it, to remove dust. But, in the preferred embodiment, the air duct 52 will be opened only at its ends.

Figure 8:
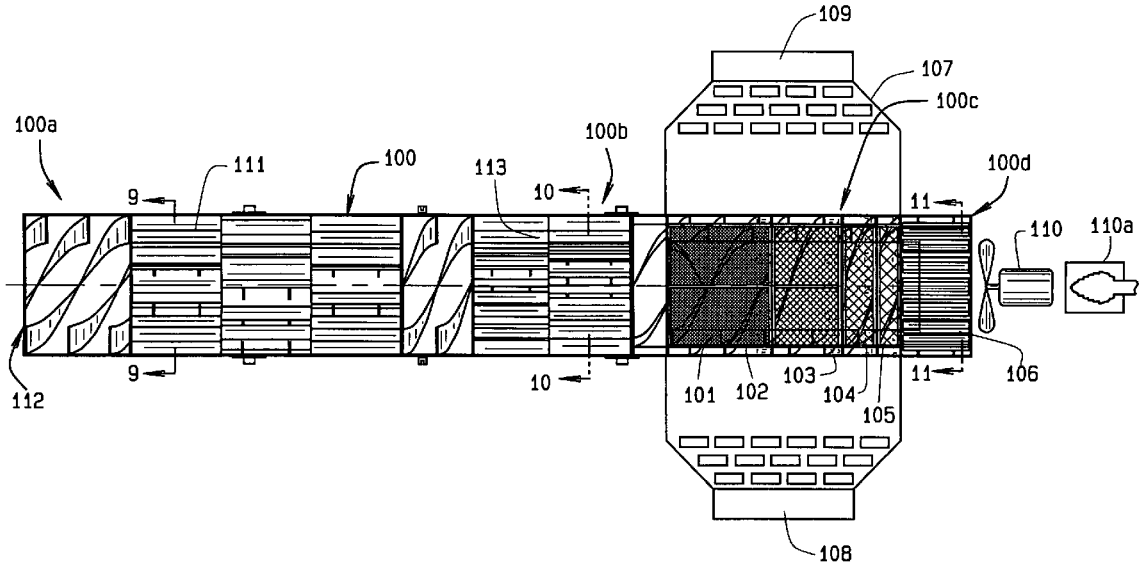
FIG. 8 shows an alternative embodiment of for the granular product blending, cooling, and screening rotary drum of this invention, showing the graduated screens within the third segment, and the location of an inner cylinder therein, to provide for passage of the cooling air in counter flow through the rotary drum.

An alternative and modified embodiment for the rotary drum 100 of this invention is shown in FIG. 8. This particular drum now has an inner cylinder 101 that extends approximately from the back end of the drum, to approximately the two thirds point, where the screens or outlets for the graded material commences. Generally, as previously reviewed, the drum is made up of various segments. There is an entrance segment approximately at 100*a*, an intermediate segment, at approximately 100*b*, and a screening segment at approximately 100*c*. Then, there is the exit region, at approximately 100*d*, as can be noted.

At the screening segment 100*c*, there are a series of three or more screens that are provided, the screens generally being disclosed at 102, 103, 104, and 105. As can be noted, as disclosed in FIG. 8, these screens are of increasing sized mesh, so that the finer material will be screened out at the screen 102, an intermediate sized aggregate will be screened out at the screen 103, and the larger materials will be screened at the location 104 and 105. Then, there are a series of baffles, as at 106, at the exit end 100*d*, and these baffles provide for shifting forwardly, of any larger unscreened materials, for dropping off of the exit end, for collection, or to be conveyed away, as known in the art. Also as can be seen, and as previously explained, as in the application, a dust collector 107 is provided, and flows air generally from the bottom, to its top, to collect any finds and dusts that may be airborne, and dispose of it, for environmental purposes. Furthermore, it is just as likely that the air flow may be downwardly, to collect dust in that manner also. The dust will exit either end, as at 108 or 109, depending upon the direction of the air flow. What is to be noted, though, is that screening does take place externally of the cylinder 101, and therefore, the air passing through the dust collection hood 107, will pass around the cylinder 101, and attain a somewhat accelerated flow circumferencely around said cylinder, to collect the dust as it is generated and accumulates.

With respect to the screening segment 100*c*, by way of example, the screen 102 may have a mesh of approximately one sixteenth inch in size. The screen 103 may have a mesh of approximately one eighth inch in size. The screen 104 may have a mesh of approximately one quarter inch. Finally, the mesh 105 may have a screening dimension of approximately one half inch screen size. There may be more or less of these various sizes of screens, within this third segment of the rotary drum, and which sizes will be dictated and determined by the type and quantity of materials being blended, or separated, cooled, or screened in the process.

As can also be seen, a cooling means, such as the blower 110, may be provided at the exit end of the rotary drum, and force cooling air through the cylinder 101, in order to attain cooling of the granular material proximate this location, but more specifically, throughout the length of the rotary drum, including its segments 100*a* and 100*b*, so as to provide for a more rapid and advanced cooling of the temperature of the materials being graded, separated, or screened, while being processed by the rotary drum of this invention. Also, the blower 110 can be replaced by a burner 110*a*, where the materials passing through the drum may be moist, and need to be dried before screening.

Figures 9, 10, 11:
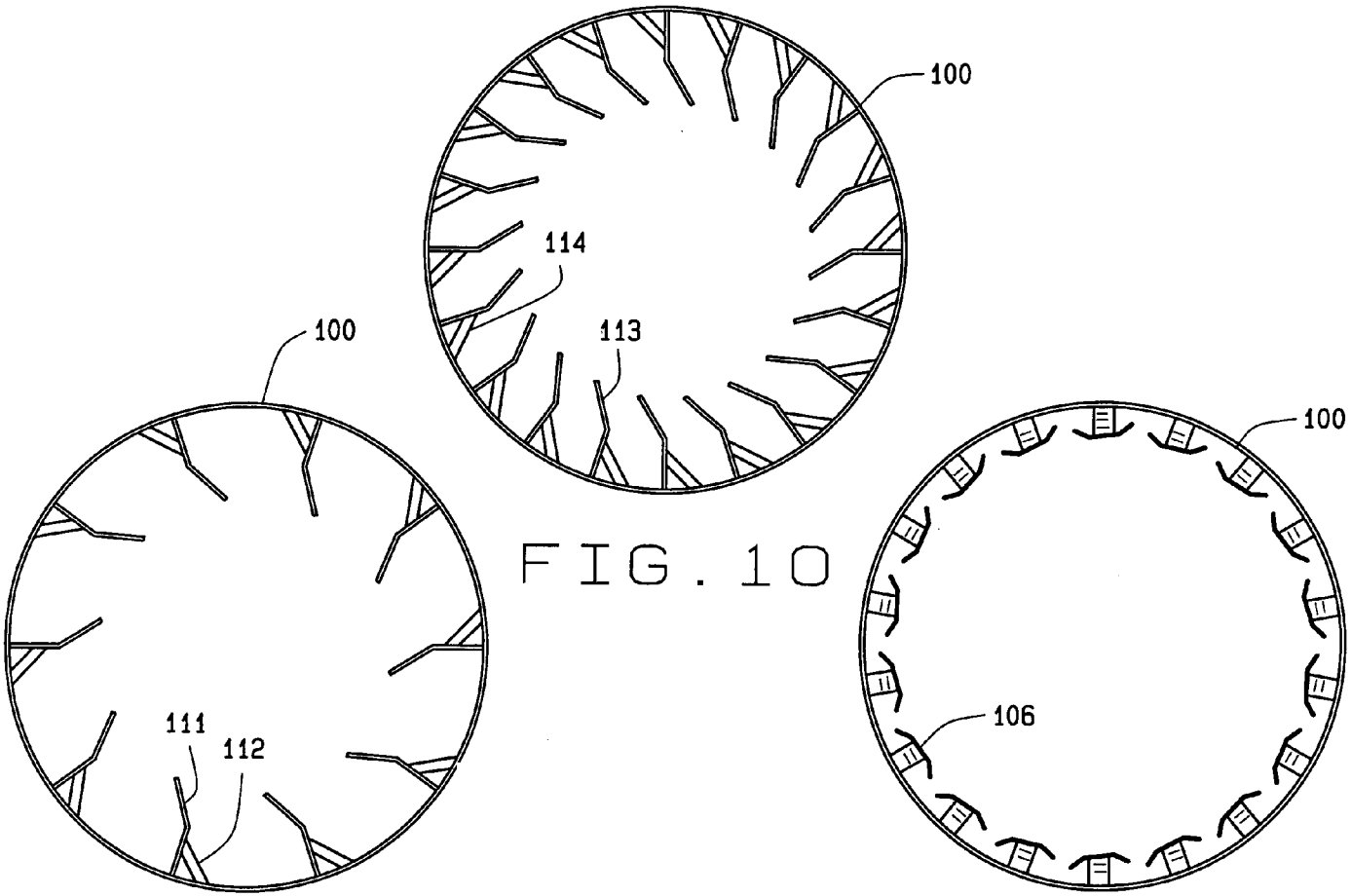
FIG. 9 shows the lifting means provided within the first segment of the rotary drum.
FIG. 10 shows the lifting means provided within the second or middle segment of the rotary drum.
FIG. 11 shows the baffles provided at the exit end of the rotary drum that provides discharge of the larger granular material that bypasses the screening segment.

As can also be seen in FIG. 9, the baffles or paddles, as at 111 are provided internally of the rotary drum, and these are provided for lifting of the granular material entering into the entrance end 112 during the initiation of its processing, and then the paddles 111 lift the material, and drop it, in order to break it up, and to initiate the cooling process, the separation of the granular material being desired to be achieved before it reaches the screening segment, as at 100*c*, of this drum. The paddles 111 may be reinforced, as at 112, through the usage of struts, to hold them in position for the continuous lifting of heavy granular material, during their extended usage and application. As can be seen in FIG. 10, the multitude of baffles 113 provided in the middle segment 100*b* of the invention can be seen in FIG. 10. These likewise are reinforced in their construction within this segment of the drum through the usage of the reinforcing struts 114.

Finally, as previously reviewed, the baffles 106 can be seen in FIG. 11. The larger material usually passes under the baffles for discharge. This also shields the materials from the heat of a burner.

During usage and through the application of the series of screens, as at 102–105, within the third segment of the drum, each of these screens has various grading abilities, as noted. One level of screens are of a smaller size, while the final segment of the screen, as at 105, may separate the larger of the granular material or debris that is passing through the drum. Once the materials are screened, they then pass through the various openings or ports, such as the various ports 56, to be discharged therefrom and pass onto the various conveyors (not shown), for transfer to a collection location.

Furthermore, the purpose for having the inner cylinder 101 provided within the rotary drum, at least at the approximate two thirds to the end position of the drum, and generally in line with the screen section, is that air can be forced through this inner cylinder, and along the entire length of the drum, to its entrance, in order to provide for more rapid and earlier cooling of the materials passing therein, and therethrough. Since the materials passing through are exothermic, and may include sand, mold sand, granular bits, pieces of burrs, slag, and any other waste material, that needs to be separated, graded, and cooled, it can be done through the use of the type of rotary drum as shown herein. Simply to spray water onto this type of material just does not work, and causes its aggregation, which prevents its being graded or separated as by screening, in the manner of this invention. This type of exothermic material simply sucks up water during its processing. Thus, it may never cool, unless cool air is allowed to flow over it, as done in this invention. Hence, this is the purpose for placing the blower as at 110, or even a burner, at the exit end, and which will blow cool air or heat through the inner cylinder, and the rest of the drum, in order to obtain its cooling and drying.

At the same time, this inner cylinder is generally aligned with the length of the screening section. Hence, where all of these materials are being screened, and fall through their various discharge ports, a significant amount of dust is generated, and the outer dust collection bin or shell, as at 107, can work more effectively, because it pulls and attracts the dust around the outside of the inner cylinder, in the proximity of the screening section, and can draw the dust, and collect it, into its, for example, upper segment, for exit out of the discharge 109, if the air is blowing in that direction. Hence, the ports at the bottom of the outer drum, as the drum rotates, allows air to be drawn therein, and which passes around the inner cylinder, and entrains the dust, and pulls in into its upper section of the dust collecting hood, for accumulation thereafter.

Hence, one of the benefits of this invention is to provide the ability to have several cuts or separations of the granular material, by screening internally, and to achieve its discharge out the plurality of ports provided through the rotary drum, or its cylinder, particularly at this third or screening segment. This all takes place after the product has been blended, the early mixed and broken down, and cooled, in the manner as previously described.

With the usage of this dual chamber design, the drum now accommodates the use of at least twice as much airflow for use in application for cooling, and for dust collecting, without increasing air velocity, and therefore, reducing energy cost. Each screen section has dust collection on top, and the makeup air is drawn from the bottom discharge openings, around the inner cylinder, to achieve dust collection. The dust collection on the intake end uses makeup air from the opposite end for counter flow cooling, thus air cannot short circuit the dust collection, over the screens, because the inner cylinder separates these functioning air flow halves.

In view of the above, it will be seen that several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

The invention claimed is:

1. A rotary blending, cooling, and screening drum for effecting the processing of granular product, comprising a rotary drum configured for slow speed rotation, said rotary drum having a cylindrical body formed of at least three segments, and an exit segment, the first segment being an intake segment provided for the intake of the granular product, the intake segment including a first series of helically arranged integral vanes for moving the granular product longitudinally along, a second segment, said second segment being a blending segment provided for blending the granular product, said second segment including a series of lifts, for lifting the granular product to achieve its mixing and reduction in size, and cooling therein, a third segment, said third segment comprising a discharge segment, said third segment including a plurality of screens, operatively associated with discharge ports within the cylindrical body at that location, and configured to provide for selective discharge of screened portions of the granular product, and said third segment further including an inner cylinder, said inner cylinder being of substantially lesser diameter than the diameter of the third segment, said inner cylinder extending approximately the length of the said third segment, and said inner cylinder allowing for passage of counter flowing air from the exit segment through the first and second segments of the rotary drum to attain cooling of the granular product as processed and passing therethrough.

2. The rotary drum of claim 1 and including a blower provided at the exit end of the rotary drum and furnishing the counter flow of cooling air through the inner cylinder, and through the first and second segments of the rotary drum, to attain accelerated cooling of the granular material being processed therein.

3. The rotary drum of claim 2 and including a dust collection hood provided around the approximate third segment of the rotary drum, said dust collection hood provided for flow of air therethrough, within the approximate third segment of the cylindrical body, but around internal cylinder for removing dust generated at the screening segment of the rotary drum during its operation.

4. The rotary drum of claim 2 and including the exit end of said cylinder having a series of baffles to provide for movement of the remaining unscreened granular material out of the rotary drum during its operation.

5. The rotary drum of claim 4 and including a series of lifts provided within the first and second segments of the cylindrical body.

6. The rotary drum of claim 1 and including a burner provided at the exit end of the rotary drum to provide the passage of heat through the rotary drum to dry any moist materials passing therethrough.

7. A rotary blending, cooling, and screening drum for effecting the processing of granular product, comprising a rotary drum configured for slow speed rotation, said rotary drum having a cylindrical body formed of at least three segments, and an exit segment, the first segment being an intake segment provided for the intake of the granular product, the intake segment including a first series of helically arranged integral vanes for moving the granular product longitudinally along, a second segment, said second segment being a blending segment provided for blending the granular product, said second segment including a series of lifts, for lifting the granular product to achieve its mixing, reduction in size, and cooling therein, a third segment, said third segment including a plurality of screens, operatively associated with discharge ports within the cylindrical body at that location, and configured to provide for selective discharge of screened portions of the granular product, said third segment further including an inner cylinder, to allow for passage of counter flowing air from the exit end through the first and second segments of the rotary drum to attain cooling of the granular product as processed and passing therethrough, said inner cylinder extending the length of the third segment of said rotary drum, and having a diameter less than the diameter of the cylindrical body of said rotary drum, a blower provided at the exit end of the rotary drum and furnishing a counter flow of cooling air through the inner cylinder, and through the first and second segments of the rotary drum, to attain accelerated cooling of the granular material being processed therein, the exit end of said cylinder having a series of baffles to provide for movement of the remaining unscreened granular material out of the rotary drum during its operation, each baffle includes a plate, each plate having beveled edges, and structural support connecting with the underside of each plate and securing internally of the cylindrical body, such baffles being arranged internally around the inner perimeter of said cylindrical body at the exit end of the rotary drum, to allow passage of residue material to exit the rotary drum.

* * * * *